US011519586B2

(12) United States Patent
Yang

(10) Patent No.: US 11,519,586 B2
(45) Date of Patent: Dec. 6, 2022

(54) LAMP

(71) Applicant: Yi Yang, Shanghai (CN)

(72) Inventor: Yi Yang, Shanghai (CN)

(73) Assignee: SHANGHAI BLUE LAKE LIGHTING TECH. CO., LTD., Shanghai (CN)

( * ) Notice: Subject to any disclaimer, the term of this patent is extended or adjusted under 35 U.S.C. 154(b) by 51 days.

(21) Appl. No.: 16/967,574

(22) PCT Filed: Jan. 11, 2019

(86) PCT No.: PCT/CN2019/071267
§ 371 (c)(1),
(2) Date: Feb. 17, 2021

(87) PCT Pub. No.: WO2019/154007
PCT Pub. Date: Aug. 15, 2019

(65) Prior Publication Data

US 2021/0180771 A1 Jun. 17, 2021

(30) Foreign Application Priority Data

Feb. 7, 2018 (CN) ..... 201810124298.5

(51) Int. Cl.
*F21V 13/04* (2006.01)
*F21V 5/02* (2006.01)
(Continued)

(52) U.S. Cl.
CPC ..... *F21V 13/04* (2013.01); *F21V 5/02* (2013.01); *F21V 5/048* (2013.01); *F21V 7/0033* (2013.01);
(Continued)

(58) Field of Classification Search
CPC ..... F21V 13/04; F21V 5/08; F21V 7/0025; F21V 7/0066
See application file for complete search history.

(56) References Cited

U.S. PATENT DOCUMENTS 5,582,480 A * 12/1996 Zwick ..... F21S 43/31 362/298
8,389,945 B1 3/2013 Vinogradov et al.
(Continued)

FOREIGN PATENT DOCUMENTS

CN 103765434 A 4/2014
CN 204494207 U 7/2015
(Continued)

OTHER PUBLICATIONS

Int'l Search Report for PCT/CN2019/071267, dated Mar. 28, 2019.

*Primary Examiner* — Julie A Bannan
(74) *Attorney, Agent, or Firm* — Blue Filament Law PLLC

(57) ABSTRACT

A lamp is provided that includes a light source (1101) including at least one light emitting point (S0); and a light receiving device located between the light source (1101) and the optical path of a collimating optical element (1104, 3104), the light receiving device at least includes at least two light guides (1102, 1103, 3302), for respectively collecting light beams (1301, 1303, 3301, 3303) emitted at different angles from the light emitting point (S0) of the light source (1101), and respectively directing the collected light beams (1301, 1303, 3301, 3303) to the collimating optical element (1104, 3104) in a reflective or refractive manner, after which the light beams forming parallel light after the collimation of the collimating optical element (1104, 3104); and further includes a mirror array (1105, 3105) for reflecting the parallel light to form a reflected light spot array.

9 Claims, 4 Drawing Sheets

(51) Int. Cl.
*F21V 5/04* (2006.01)
*F21V 7/00* (2006.01)
*F21Y 115/30* (2016.01)

(52) U.S. Cl.
CPC ..... *F21V 7/0083* (2013.01); *F21Y 2115/30* (2016.08)

(56) References Cited

U.S. PATENT DOCUMENTS

| | | | | |
|---|---|---|---|---|
| 2005/0162854 | A1* | 7/2005 | Finch | F21S 43/30 362/304 |
| 2010/0246186 | A1* | 9/2010 | Chang | F21V 7/0008 362/294 |
| 2016/0046388 | A1* | 2/2016 | Jha | B64D 47/04 362/470 |

FOREIGN PATENT DOCUMENTS

| | | | |
|---|---|---|---|
| CN | 105651187 | A | 6/2016 |
| CN | 107166180 | A | 9/2017 |
| CN | 108167710 | A | 6/2018 |
| CN | 207741023 | U | 8/2018 |
| CN | 207831134 | U | 9/2018 |
| CN | 208185913 | U | 12/2018 |
| JP | 2012059575 | A | 3/2012 |

* cited by examiner

LAMP

TECHNICAL FIELD

The present disclosure relates to the lighting field and, in particular, to the field of decorative lighting.

BACKGROUND

Lamps belong to a traditional field, and there are many kinds of lamps. After emergence of LEDs, lamps using LEDs as light sources are also endlessly emerging. However, with improvement of our living standards, there is an increasing demand for lighting, especially decorative lighting, while this demand has not yet been fully satisfied.

SUMMARY

The present disclosure provides a lamp, and the lamp including: a light source including at least one light-emitting point, each of the at least one light-emitting point having a light-emitting full angle of A; a collimating optical element, where a distance between a focal point of the collimating optical element and a plane of the collimating optical element is F, an effective aperture of the collimating optical element is D, and the collimating optical element is configured to collimate an incident light beam having a light-emitting full angle of B and emitted from the focal point into parallel light, where B=2*arctg(D/2F), and B is smaller than A/2; a light-collecting device located on a light path between the light source and the collimating optical element, the light-collecting device including at least two light guiding members that are configured to respectively collect light beams emitted from the at least one light-emitting point of the light source at different angles and respectively guide, through reflection or refraction, the collected light beams to the collimating optical element to form the parallel light after being collimated by the collimating optical element; and a reflector array configured to reflect the parallel light to form a reflection light spot array.

The light-collecting angle B of the collimating optical element is smaller than half of the light-emitting full angle of the light-emitting point, in this way, through the light guiding members of the light-collecting device, at least two light beams having different angles, which are emitted from the light-emitting point, can be projected to the collimating optical element to form parallel light beams respectively, and this is equivalent to that the light-emitting point is regarded as at least two equivalent virtual light-emitting points, then the number of small light spots formed after reflection of the reflector array is at least doubled, so that a decoration effect can be improved.

DESCRIPTION OF EMBODIMENTS

Figure 1A:
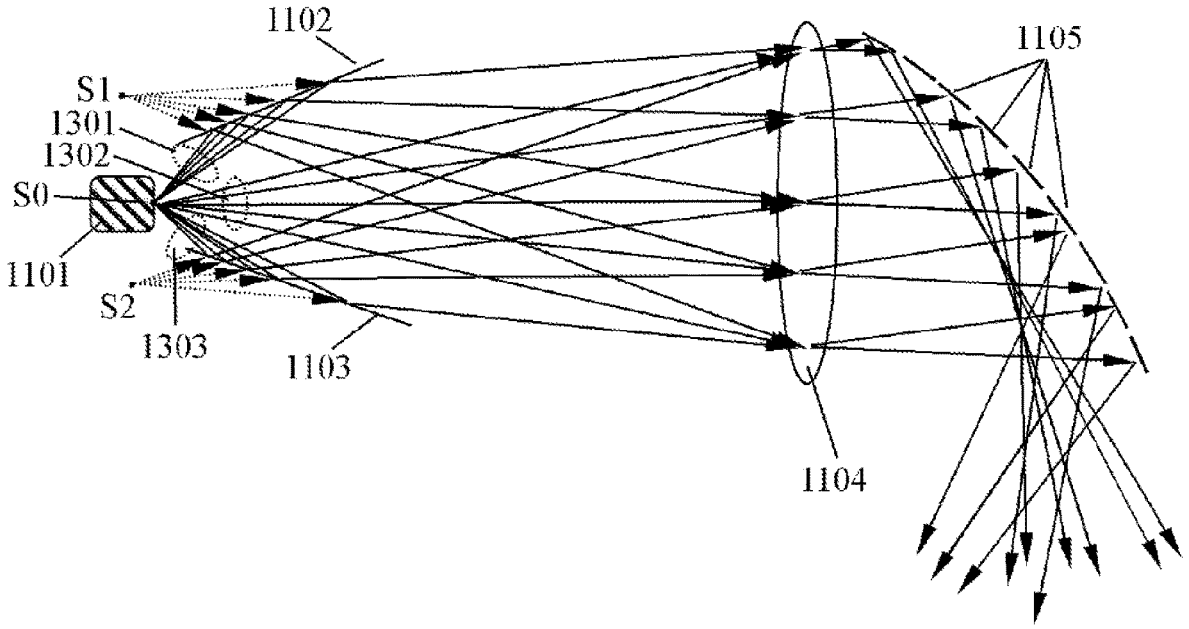
FIG. 1A is a structural schematic diagram of a lamp according to a first embodiment of the present disclosure.

The present disclosure provides a lamp, and a structural schematic diagram of the lamp according to a first embodiment as shown in FIG. 1A. The lamp includes a light source 1101 including at least one light-emitting point S0. A light-emitting full angle A of the light-emitting point S0 is larger than 60 degrees. The lamp further includes a collimating optical element 1104, a distance between a focal point of the collimating optical element and a plane of the collimating optical element is F, and an effective aperture of the collimating optical element is D. The collimating optical element is configured to collimate an incident light beam, which is emitted from the focal point and has a light-emitting full angle of B, into parallel light, where B=2*arctg (D/2F). According to optical knowledge, B is a light-collecting full angle of the collimating optical element, i.e., an opening angle of the element facing the focal point. The light-collecting full angle B is smaller than half of the light-emitting full angle of the light-emitting point S0, i.e., A/2.

The lamp further includes a light-collecting device located on a light path between the light source 1101 and the collimating optical element 1104. The light-collecting device includes at least two light guiding members 1102 and 1103. The light guiding member 1102 is configured collect light beam 1301 emitted from the light-emitting point of the light source at an angle, and guide the light beam collected by the collimating optical element 1104 in a reflective manner, and the light guiding member 1103 is configured collect light beam 1303 emitted from the light-emitting point of the light source at different angle from the light beam 1301, and guide the light beam collected by the collimating optical element 1104 in a reflective manner. After being collimated by the collimating optical element, the light beams form the parallel light. The lamp further includes a reflector array 1105 configured to reflect the parallel light to form a reflected light spot array.

In order to clearly explain a working principle of the present disclosure, a case after a beam of parallel light is incident on the reflector array is first considered. Each sub-reflector of the reflector array can reflect a part of the parallel light incident on it to form a small light beam, and the small light beam can form a small light spot on a screen in a far field. The small light spot is an image formed by the light source going through the collimating optical element and the sub-reflector. It can be understood that the number of the formed small light spots is equal to the number of the sub-reflectors. In a case of decorative lighting, the larger the number of the small light spots, the brighter the small light spots, and the better the effect. However, it can be understood that the more the sub-reflectors, the more the small-light spots, but the more the sub-reflectors also mean the smaller the sub-reflector, in this way, less energy is projected thereon, and brightness of the small light spot is reduced. Moreover, in practice, a size of the sub-reflector is limited by cutting and assembly, and it cannot be very small. In other words, the number of the sub-reflectors is increased to increase the number of the small light spots, which runs counter to a brightness performance of the small light spot. Therefore, it is desired to find a method that can increase the number of the small light spots without increasing the number of the sub-reflectors. The present disclosure proposes such a method.

In an embodiment, the light guiding member is a reflector, and two reflectors (light guiding members) 1102 and 1103 are shown in FIG. 1A. An upper light beam 1301 emitted by the light source S0 is reflected and guided by the reflector 1102 to the light collimating element 1104, and a lower light beam 1303 emitted by the light source S0 is reflected and guided by the reflector 1103 to the light collimating element 1104. According to a principle of reversibility of light paths, the two light beams 1301 and 1303 correspond to two virtual light-emitting points S1 and S2, respectively, that is, an optical effect thereof is the same as an effect of the two beams of light emitted from the virtual light-emitting points S1 and S2. Therefore, as long as a position of the light collimating element 1104 is designed so that the virtual light-emitting points S1 and S2 are located on a focal plane of the light collimating element 1104, it can be realized that the two light beams form parallel light beams after passing through the light collimating element. The two parallel light beams formed at this time are equivalent to that they are emitted from the two virtual light-emitting points S1 and S2, that is, they correspond to two light-emitting points. After these two parallel light beams are reflected by the reflector array 1105, each sub-reflector of the reflector array can be respectively irradiated by the two parallel light beams respectively, that is, two small light beams will be formed, and two small light spots are formed. The two small light spots are images of the virtual light-emitting points S1 and S2, respectively. In this way, the number of the small light spots is doubled without increasing the number of the sub-reflectors.

This aspect can be established based on a premise that the light-collecting angle of the light collimating element is smaller than half of the light-emitting angle of the light-emitting point S0. The present disclosure can be understood as follows: the light-emitting angle A of light emitted by S0 is divided into multiple parts by the light guiding member of the light-collecting device, each of the parts corresponds to one virtual light-emitting point, and each of the parts can achieve a light divergence angle of B, such that the light beam emitted by each virtual light-emitting point can cover a range of the light collimating element and be collimated by the light collimating element. In this way, in order to at least be able to divide the light-emitting angle A of the light-emitting point into two parts (that is, to form two virtual light-emitting light spots, and to double the number of the small light spots), and to make each of the parts realize the light divergence angle of B, it is required that $B<A/2$.

In an embodiment, the light beam 1302 around an optical axis of the light-emitting point S0 is not guided by the light-collecting device, but it is directly emitted and projected onto the light collimating element 1104. Without doubt, this part of the light can also be affected by the light collimating element 1104 to form parallel light, and to form multiple small light spots after the reflection of the reflector array. Therefore, in this embodiment, by being affected by the light-collecting device, two virtual light-emitting points S1 and S2 are additionally added besides the light-emitting point S0, that is, in terms of optical effect, it is equivalent to that three light-emitting points of S0, S1, and S2 emit light at the same time. In this way, after going through the light collimating element and the reflector array, small light spots that are three times the number of the sub-reflectors can be formed. It is easy to understand that FIG. 1A only shows two light guiding members 1102 and 1103 on the paper, then there is a space for adding other light guiding members outside the paper, so that more small light spots can be formed. Without doubt, in the present disclosure, under the premise of $B<A/2$, with reasonable design, the number of the small light spots is at least twice the number of the sub-reflectors.

In an embodiment, the light-emitting full angle A of the light-emitting point S0 is larger than 60 degrees, for example, A is 70 degrees. In this case, the light-collecting full angle B of the collimating optical element should be smaller than 35 degrees. If B is even smaller, for example, B is equal to 20 degrees, then the light emitted by the light-emitting point S0 can be divided into more parts, and it is equivalent to that multiple virtual light-emitting points project light having the full angle of B to the collimating optical element. Actually, the light-emitting full angle of S0 can also be 40 degrees, and in this case, as long as B is smaller than 20 degrees, the requirements of the present disclosure can be met.

From another perspective, if the light-collecting full angle B of the collimating optical element is preset, then only the part of light within the angle A in the light-emitting point S0 is utilized, and remaining light will be wasted. For example, it is set that B=20 degrees, and A is set to 60 degrees (satisfying $B<A/2$). Considering that most light sources emit light that is nearly isotropic, for example, a LED light source, the light-emitting full angle thereof is 180 degrees, then only light with the 60 degrees of the 180 degrees are utilized, and the rest is wasted.

Figure 1B:
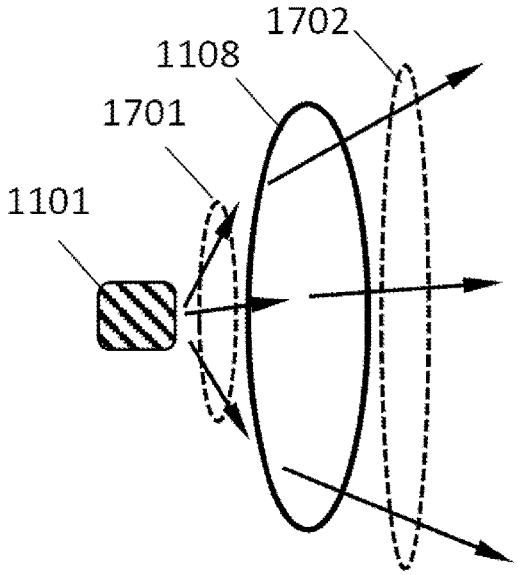
FIG. 1B is a schematic diagram of an optical path when a convex lens is used as a light angle compression element according to a first embodiment of the present disclosure.
Figure 1C:
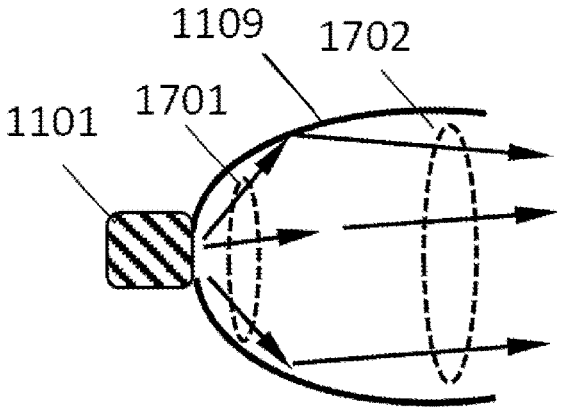
FIG. 1C is a schematic diagram of an optical path when a reflector cup is used as a light angle compression element according to a first embodiment of the present disclosure.

In order to improve an energy utilization rate, the light source also includes a convex lens or a lens group, which is configured to compress a light-emitting angle of large-angle light emitted by the light-emitting point of the light source. For example, as shown in FIG. 1B, the convex lens or a convex lens group 1108 can collect light 1701 having a full angle of 130 degrees emitted from the light source 1101 and emit light having a full angle of 70 degrees. This is equivalent to that A is equal to 70 degrees, and in this case, B is equal to 20 degrees, which can achieve the beneficial effects of the present disclosure, while in this case, light within 130 degrees in the light emitted by the light source is utilized, and the utilization rate is obviously much higher than the case where only light within 70 degrees in light is utilized. A role of the convex lens or the lens group is to receive large-angle incident light and compress it to form exiting light having a relatively small angle, whereas, obviously, other light angle compression elements including reflector cups can also achieve the same purpose. For example, the reflector cup 1109 shown in FIG. 1C can realize collecting light 1701 having a full angle of 130 degrees and emit light 1702 having a full angle of 70 degrees. That is, the light angle compression element included in the light source is configured to receive light having an angle range of C emitted from the light source and emit light having a full angle of A, where $C>A$.

In the embodiment shown in FIG. 1A, S0, which is taken as a real light-emitting point, forms two virtual light-emitting points S1 and S2 under the effect of the light-collecting device. However, light paths of the virtual light-emitting points S1 and S2 are the same (symmetrically up and down) and can be located on the focal plane of the light collimating element. However, a light path of the light 1302 emitted by S0 is obviously shorter than a light path of the light emitted by S1 (this is due to that the light path of S1 is reflected by the reflector 1102 before reaching the light collimating element, and according to the triangle principle, a sum of lengths of two sides must be larger than that of a length of the third side). Therefore, when S1 and S2 are located on the focal plane of the light collimating element, S0 must be located between the focal plane and the light collimating element, so that the light beam 1302 emitted by the defocused S0 will not be perfectly collimated by the light collimating element and forms a relatively large small light spot by the reflector array.

Figure 2:
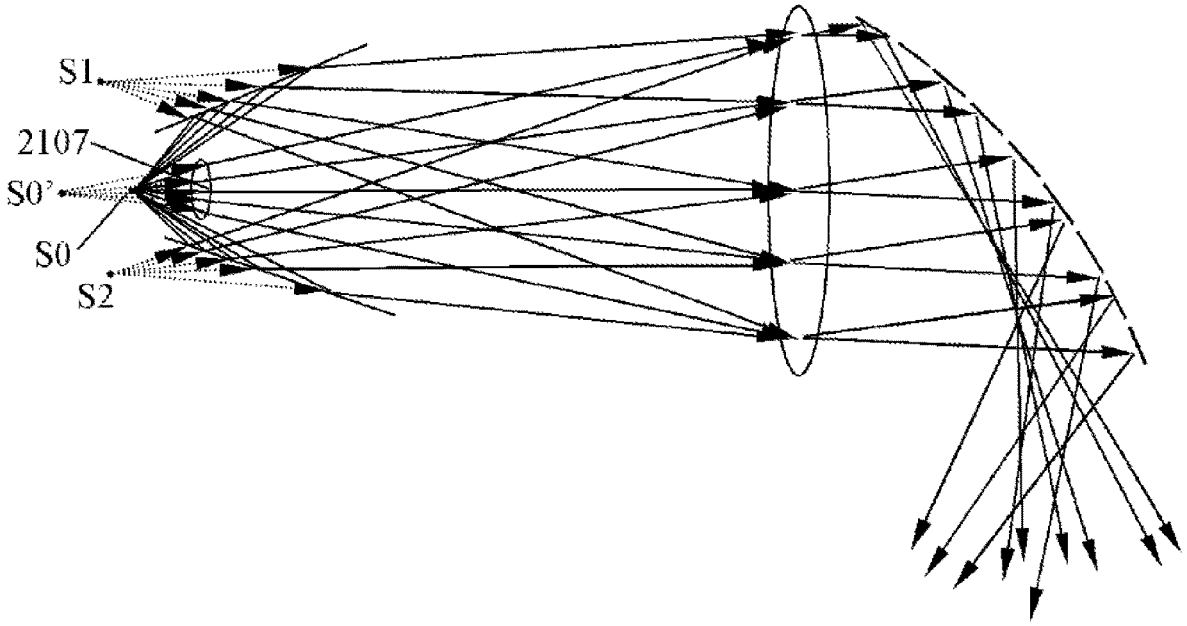
FIG. 2 is a structural schematic diagram of a lamp according to another embodiment of the present disclosure.

In another embodiment of the present disclosure, for light directly emitted by the real light-emitting point S0, another kind of light guiding member is used, to form another virtual light-emitting point, which solves this problem. A structural schematic diagram of this embodiment is as shown in FIG. 2.

A difference between this embodiment and the embodiment shown in FIG. 1A is that: in this embodiment, another light guiding member 2107 including a convex lens is further included, and the convex lens 2107 is configured to collect light around the optical axis of the light-emitting point. Moreover, the reflector is configured to collect light emitted from the light-emitting point away from the optical axis. A light beam emitted from the light-emitting point S0 is refracted by the convex lens 2107 and then transmitted to the light collimating element, while according to the principle of reversibility of light paths, its equivalent virtual light-emitting point S0' is located at a side of the real light-emitting point S0 facing away from the light collimating element. With reasonable design, S0', S1, and S2 can have the same light distance, and are all located on the focal plane of the light collimating element. In this way, it can be simultaneously ensured that three light beams are perfectly collimated after passing through the light collimating element, to further ensure that all small light spots reach the smallest and brightest.

Another function of using the convex lens 2107 is that after the light beam is condensed by the convex lens, its light-emitting angle is B (corresponding to the light-collecting angle of the light collimating element), then the light-collecting angle of the convex lens must be larger than B, that is, larger than the light-collecting angle of the reflector. Therefore, compared with the virtual light-emitting points S1 and S2, the light beam emitted by the virtual light-emitting point S0' contains more energy, and the small light spot finally formed are also larger. An advantage brought by this is that there are large and small, bright and dark small light spots among the multiple small light spots finally formed by the reflector array, achieving a better decorative effect and a more perspective effect in terms of vision. Therefore, the convex lens 2107 can make an intermediate light beam have more energy and make the virtual light-emitting point S0' be located on the focal plane of the light collimating element, so that the small light spots formed by the virtual light-emitting point S0' are brighter and clearer.

In the above description, light guiding members are depicted in multiple places, while the light guiding members can refer to different elements. For example, in the embodiment shown in FIG. 1A, the light guiding members are the reflectors 1102 and 1103. However, in the embodiment shown in FIG. 2, some light guiding members are still reflectors, and one light guiding member is convex lenses; in following embodiments, the light guiding member can also be a prism. No matter what kind of light guiding member, it plays the role of guiding a light beam to be transmitted to the light collimating element, thus, under the premise of not causing misunderstanding of the description, in this specification, such elements are collectively referred to as light guiding members. Even in the embodiment shown in FIG. 2, different light guiding members can be different elements, which does not affect understanding of the solution of the present disclosure by readers.

Figure 3A:
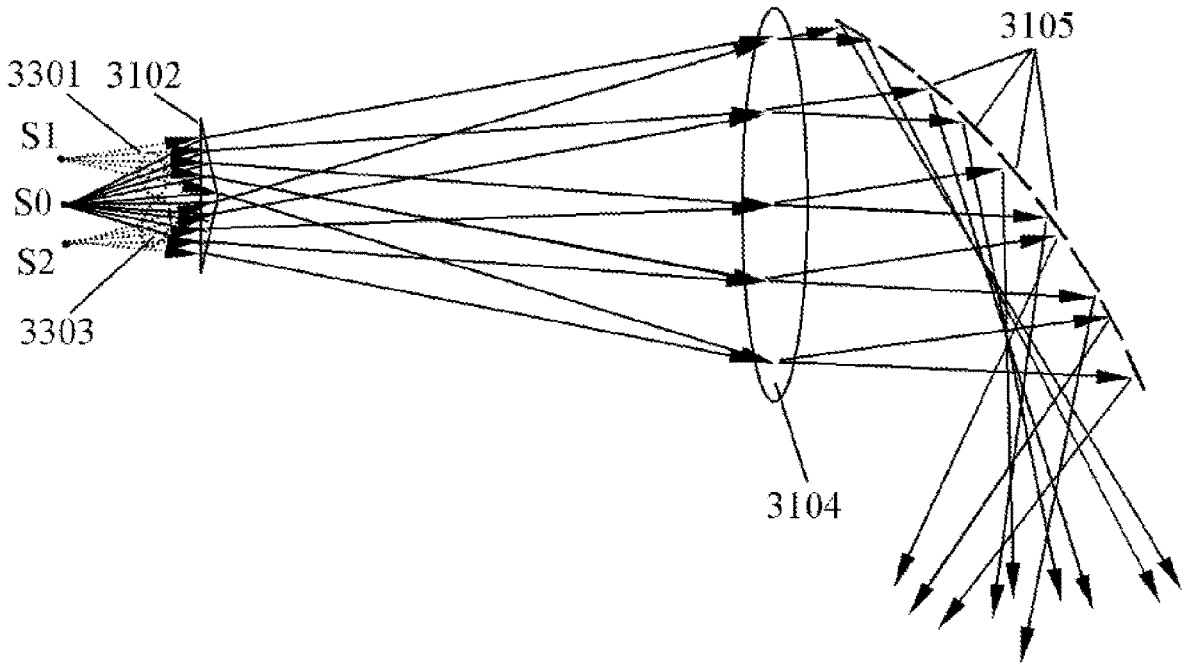
FIG. 3A is a structural schematic diagram of a lamp according to another embodiment of the present disclosure.

In the above-described embodiment, the reflector is used as the light guiding member. Actually, the prism can also be used as a light guiding member. The reflector guides the light beam to reach the light collimating element by reflection, while the prism guides the light beam to reach the light collimating element by refraction. In another embodiment shown in FIG. 3A, the light emitted by the light-emitting point S0 is divided into two parts in a vertical direction, an upper half part 3301 is incident on an upper half part of the prism 3102, and a lower half part 3303 of the light is incident on a lower half part of the prism 3102. The two parts of light 3301 and 3303 are respectively refracted at different positions of the prism and respectively guided to a light collimating element 3104, and after being collimated by the light collimating element 3104, they are reflected by a reflector array 3105 to form a plurality of small light spots. According to the principle of reversibility of light paths, the two parts of light 3301 and 3303 correspond to the virtual light-emitting points S1 and S2, respectively, so that small light spots twice as many as the number of the sub-reflectors on the reflector array can be realized.

In this embodiment, the light-collecting device is a prism 3102, while this light-collecting device includes two light guiding members, namely, one light guiding member is an upper half part of the prism 3102, the other light guiding member is a lower half part of the prism, and these two light guiding members are formed into one piece to form a large prism. Light-emitting angles of light-emitting points corresponding to these two light guiding members (that is, upper and lower parts of the prism 3102) are the same, and such a symmetrical design can ensure that light distances of light guided by the two parts are the same, so that the two virtual light-emitting points S1 and S2 can be designed to be located on the focal plane of the light collimating element at the same time.

Figure 3B:
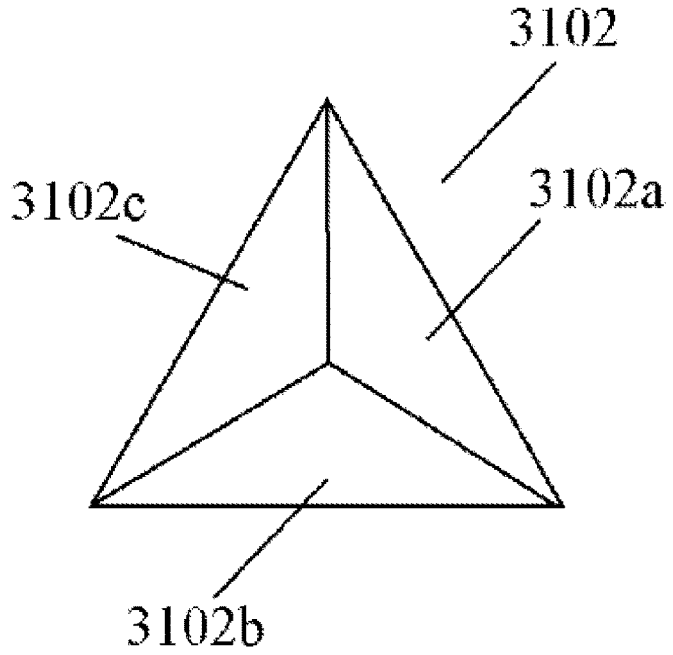
FIG. 3B illustrates a light-collecting device in the form of a prism used in the embodiment of FIG. 3A.

In another example of this embodiment, a front view of the prism 3102 is shown in FIG. 3B. It can be seen that this light-collecting device includes three light guiding members 3102*a*, 3102*b* and 3102*c*, and each of the light guiding members is a small prism, to guide light beams emitted from different directions to the light collimating element. It can be understood that three virtual light-emitting points can be formed, so as to finally achieve small light spots three times the number of the sub-reflectors.

Figure 4:
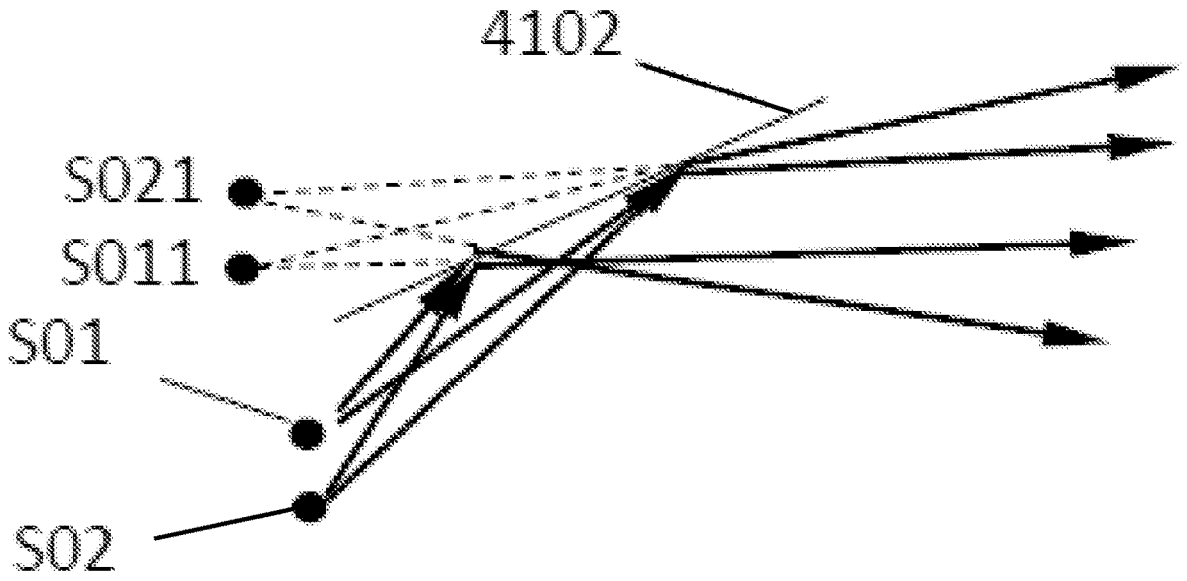
FIG. 4 is a schematic diagram of an optical path when the present disclosure includes at least one light-emitting point and reuse of the light guiding members.

In the foregoing embodiments, there is only one real light-emitting point, and at least two virtual light-emitting points are derived from this real light-emitting point, to achieve the purpose of multiplying small light spots. However, in order to further increase the number of the small light spots, the light source includes at least two light-emitting points, while the two real light-emitting points can both be respectively applied with light-collecting devices to generate virtual light-emitting points. As shown in FIG. 4, the lamp includes two light-emitting points S01 and S02. Preferably, light-collecting devices corresponding to different light-emitting points reuse at least one light guiding member, reducing system complexity and cost. For example, when the same reflector 4102 is used as the light guiding member, it can be reused as the light guiding member for two real light-emitting points S01 and S02, to generate two corresponding virtual light-emitting points S011 and S021, respectively. Similarly, when the method is used in the embodiment shown in FIGS. 3A and 3B, the prisms shown in FIG. 3A and FIG. 3B can also be used as light guiding members for two real light-emitting points, to generate corresponding virtual light-emitting points respectively. In this way, without increasing the complexity of the system, the number of the virtual light-emitting points can be greatly increased, thereby increasing the number of the small light spots.

In the description of the foregoing embodiment, the light source is not described. Actually, there can be many types of light sources, the smaller the light-emitting point of the light source, the smaller the small light spot generated, and the better the decorative effect. Therefore, preferably, the light source includes a laser and a fluorescent element, laser light emitted by the laser is incident on the fluorescent element forms one of the at least one light-emitting point, and the light-emitting point is configured to generate broad-spectrum light. Since energy of the laser light emitted by the laser is concentrated, it is easier to generate relatively small light spots. However, the fluorescent element can be excited at this small excitation point to generate high-brightness white light, realizing a light source having a small light-emitting point area. More preferably, the light source further includes a diaphragm located at a rear end of a light path of the fluorescent element and closely attaching on the fluorescent element, and an aperture of the diaphragm covers the light-emitting point of the light source. This can make an edge of the light-emitting point of the light source sharper, thereby realizing a small light spot array having higher contrast, to realize better visual effects.

In the description of the above embodiments, the light collimating element is a convex lens, and the reflector arrays are all in an upward-convex shape. Actually, the light collimating element can also be a curved reflector, and the reflector array can also have a downward-convex shape. Obviously, it is enough that the light collimating element and the reflector array can realize the functions defined in the present disclosure, and their specific forms are not limited.

The above are only the embodiments of the present disclosure and do not limit the scope of the present disclosure. Any equivalent structure or equivalent process transformation made by using the content of the description and drawings of the present disclosure, or those directly or indirectly applied to other related technical fields are included in the scope of patent protection of the present disclosure in the same way.

What is claimed is:

1. A lamp, comprising:

a light source comprising at least one light-emitting point, each of the at least one light-emitting point having a light-emitting full angle of A;

a collimating optical element, wherein a distance between a focal point of the collimating optical element and a plane of the collimating optical element is F, an effective aperture of the collimating optical element is D, and the collimating optical element is configured to collimate an incident light beam having a light-emitting full angle of B and emitted from the focal point into parallel light, where B=2*arctg(D/2F), and B is smaller than A/2;

a light-collecting device located on a light path between the light source and the collimating optical element, the light-collecting device comprising at least two light guiding members that are configured to respectively collect light beams emitted from the at least one light-emitting point of the light source at different angles and respectively guide, through reflection or refraction, the collected light beams to the collimating optical element, to form the parallel light after being collimated by the collimating optical element; and a reflector array configured to reflect the parallel light to form a reflection light spot array;

wherein each of the at least two light guiding members comprises a prism.

2. The lamp according to claim 1, wherein each of the at least two light guiding members comprises a reflector.

3. The lamp according to claim 2, further comprising:

another light guiding member comprising a convex lens, wherein the convex lens is configured to collect light around an optical axis of the light-emitting point, and the reflector is configured to collect light emitted from the light-emitting point away from the optical axis.

4. The lamp according to claim 3, wherein a light-collecting angle of the convex lens is greater than a light-collecting angle of the reflector.

5. The lamp according to claim 1, wherein the light source comprises a light angle compression element configured to receive light having an angle range of C and emitted from the light source, and emit light having a full angle of A, where C>A.

6. The lamp according to claim 1, wherein the at least two light guiding members comprise two prisms, and light-emitting angles of light-emitting points corresponding to the two prisms are the same.

7. The lamp according to claim 1, wherein the at least two light guiding members comprise two prisms that are formed into one piece.

8. The lamp according to claim 1, wherein the light source comprises at least two light-emitting points, and light-collecting devices corresponding to different light-emitting points of the at least two light-emitting points; and wherein the light-collecting devices reuse at least one of the at least two light guiding members.

9. The lamp according to claim 1, wherein the light source comprises a laser and a fluorescent element, laser light emitted by the laser is incident on the fluorescent element forms one of the at least one light-emitting point, and the light-emitting point is configured to generate broad-spectrum light.

* * * * *